US011432621B2

(12) United States Patent
Shah

(10) Patent No.: US 11,432,621 B2
(45) Date of Patent: Sep. 6, 2022

(54) METAL ONE PIECE SECURITY SLIDE AND PULL FOR SLIDE FASTENER

(71) Applicant: Shah Technologies, LLC, Palm Beach Gardens, FL (US)

(72) Inventor: Nirav Ashok Shah, Mumbai (IN)

(73) Assignee: Shah Technologies, LLC, Palm Beach Gardens, FL (US)

( * ) Notice: Subject to any disclaimer, the term of this patent is extended or adjusted under 35 U.S.C. 154(b) by 0 days.

(21) Appl. No.: 17/320,421

(22) Filed: May 14, 2021

(65) Prior Publication Data

US 2021/0267323 A1 Sep. 2, 2021

Related U.S. Application Data

(63) Continuation-in-part of application No. 16/119,508, filed on Aug. 31, 2018, now Pat. No. 11,006,703, which is a continuation-in-part of application No. 15/385,294, filed on Dec. 20, 2016, now Pat. No. 10,064,457, which is a continuation-in-part of application No. 15/385,000, filed on Dec. 20, 2016, now Pat. No. 10,064,455.

(51) Int. Cl.
*A44B 19/30* (2006.01)

(52) U.S. Cl.
CPC ..... *A44B 19/30* (2013.01)

(58) Field of Classification Search
CPC ..... A44B 19/30; A44B 19/26; A44B 19/262
See application file for complete search history.

(56) References Cited

U.S. PATENT DOCUMENTS

| | | | |
|---|---|---|---|
| 2,229,216 | A | 1/1941 | Marinsky |
| 2,274,161 | A | 2/1942 | Poux |
| 2,509,278 | A | 5/1950 | Scheuermann et al. |
| 2,705,345 | A | 4/1955 | Epple |
| 2,736,062 | A | 2/1956 | Scheuermann et al. |
| 3,018,534 | A | 1/1962 | Huelster |

(Continued)

FOREIGN PATENT DOCUMENTS

| | | |
|---|---|---|
| CA | 3019584 | 10/2017 |
| CN | 2167578 | 6/1994 |

(Continued)

OTHER PUBLICATIONS

Anonymous, "How die casting machine produce zipper slider", Internet article retrieved Jun. 14, 2016, http://www.kinghuamc.com/how-die-casting-machine-produce-zipper-slide/, (2016).

*Primary Examiner* — David M Upchurch
(74) *Attorney, Agent, or Firm* — McHale & Slavin, P.A.

(57) ABSTRACT

The invention involves a securable slider assembly for a zipper. The securable slider assembly is formed in a single die cast operation to include the securable slider and the pull being formed simultaneously. At least one side shifting slide is incorporated into the die, which allows the bridge and pull loop to be formed with their full geometric shape and without the converging flat surfaces required in the prior art. The slide assembly includes a puller that includes geometry to allow two slides to be secured together after the closing operation of the zipper teeth and restricts the ability to separate the pullers for opening of the zipper teeth to provide security to the user.

11 Claims, 11 Drawing Sheets

(56) References Cited

U.S. PATENT DOCUMENTS

| | | | | |
|---|---|---|---|---|
| 3,129,480 | A | 4/1964 | Carlile | |
| 3,225,405 | A | 12/1965 | Moser | |
| 3,320,645 | A | 5/1967 | Burbank | |
| 3,419,943 | A | 1/1969 | Heimberger | |
| 3,793,684 | A | 2/1974 | Moertel | |
| 3,813,736 | A | 6/1974 | Fukuroi | |
| 4,081,883 | A | 4/1978 | Ishii et al. | |
| 4,102,022 | A | 7/1978 | Aoki | |
| 4,123,828 | A | 11/1978 | Akashi | |
| 4,210,196 | A | 7/1980 | Weiner | |
| 4,287,646 | A | 9/1981 | Kanzaka | |
| 4,389,758 | A | 6/1983 | Akashi | |
| 4,578,966 | A * | 4/1986 | Kasai | A44B 19/301 24/418 |
| 4,644,613 | A | 2/1987 | Kedzierski | |
| 4,679,281 | A | 7/1987 | Ishii et al. | |
| 4,719,673 | A | 1/1988 | Kubo | |
| 4,768,263 | A | 9/1988 | Fukuroi et al. | |
| 4,790,973 | A | 12/1988 | Minami et al. | |
| 4,976,014 | A | 12/1990 | Akashi et al. | |
| 4,985,969 | A | 1/1991 | Terada et al. | |
| 5,013,511 | A | 5/1991 | Akashi | |
| 5,073,103 | A | 12/1991 | Liao | |
| 5,101,538 | A | 4/1992 | Dieter | |
| 5,152,036 | A | 10/1992 | Oda et al. | |
| 5,419,019 | A | 5/1995 | Ida | |
| 5,544,394 | A | 8/1996 | Yaguramaki | |
| 5,604,962 | A | 2/1997 | Mayerhofer | |
| 5,611,121 | A | 3/1997 | Akeno et al. | |
| 5,621,954 | A | 4/1997 | Mizuno | |
| 5,625,928 | A | 5/1997 | Terada et al. | |
| 5,664,300 | A | 9/1997 | Mizuno | |
| 5,694,667 | A | 12/1997 | Mizuno | |
| 5,698,243 | A | 12/1997 | Wakabayashi | |
| 5,729,874 | A | 3/1998 | Mizuno | |
| 5,809,622 | A | 9/1998 | Yaguramaki | |
| 5,884,373 | A | 3/1999 | Kawamura | |
| 5,896,628 | A | 4/1999 | Oda | |
| 5,915,632 | A | 6/1999 | Muratsubaki et al. | |
| 5,956,819 | A | 9/1999 | Terasaki et al. | |
| 5,991,981 | A | 11/1999 | Komuro et al. | |
| 6,062,839 | A | 5/2000 | Funaya | |
| 6,094,786 | A | 8/2000 | Wakabayashi | |
| 7,320,768 | B2 | 1/2008 | Eimura | |
| 9,629,423 | B2 * | 4/2017 | Schlipper | A44B 19/301 |
| 2002/0050030 | A1 | 5/2002 | Takasawa | |
| 2003/0079317 | A1 | 5/2003 | Oda et al. | |
| 2003/0079318 | A1 | 5/2003 | Oda et al. | |
| 2003/0177616 | A1 | 9/2003 | Petravic et al. | |
| 2003/0192151 | A1 | 10/2003 | Metzger | |
| 2004/0034974 | A1 | 2/2004 | Arai et al. | |
| 2005/0086775 | A1 | 4/2005 | Bernasconi | |
| 2005/0097712 | A1 | 5/2005 | Raynor | |
| 2005/0204516 | A1 * | 9/2005 | Leva | A44B 19/26 24/385 |
| 2007/0022579 | A1 * | 2/2007 | Akashi | A44B 19/301 24/386 |
| 2007/0033776 | A1 | 2/2007 | Yoneoka | |
| 2007/0186392 | A1 | 8/2007 | Sewitch et al. | |
| 2008/0229554 | A1 * | 9/2008 | Payne | A44B 19/30 24/418 |
| 2009/0106951 | A1 * | 4/2009 | Edwards | A44B 19/301 24/399 |
| 2009/0229091 | A1 | 9/2009 | Peano | |
| 2010/0269311 | A1 | 10/2010 | Jacobsen | |
| 2012/0023714 | A1 * | 2/2012 | King | A45C 13/18 24/415 |
| 2012/0260469 | A1 | 10/2012 | Yamamoto et al. | |
| 2013/0007994 | A1 | 1/2013 | Iannello et al. | |
| 2013/0174386 | A1 | 7/2013 | Koenigkramer | |
| 2013/0255042 | A1 | 10/2013 | Keyaki et al. | |
| 2013/0291350 | A1 | 11/2013 | Cowin et al. | |
| 2013/0312230 | A1 | 11/2013 | Chang et al. | |
| 2014/0082896 | A1 | 3/2014 | Li et al. | |
| 2015/0113771 | A1 | 4/2015 | Keyaki et al. | |
| 2015/0201716 | A1 | 7/2015 | Septien-Rojas et al. | |
| 2015/0203251 | A1 | 7/2015 | Anzini et al. | |
| 2015/0335107 | A1 * | 11/2015 | Hamada | A44B 19/262 24/429 |
| 2017/0318914 | A1 | 11/2017 | Shah | |

FOREIGN PATENT DOCUMENTS

| | | |
|---|---|---|
| CN | 1287912 | 3/2001 |
| CN | 1338370 | 3/2002 |
| CN | 1105629 | 4/2003 |
| GB | 2220608 | 1/1990 |
| GB | 2289917 | 6/1995 |

* cited by examiner

METAL ONE PIECE SECURITY SLIDE AND PULL FOR SLIDE FASTENER

PRIORITY CLAIM

In accordance with 37 C.F.R. 1.76, a claim of priority is included in an Application Data Sheet filed concurrently herewith. Accordingly, the present invention claims priority as a continuation-in-part of U.S. patent application Ser. No. 16/119,508, entitled "Metal One Piece Slide and Pull for Slide Fastener", filed Aug. 31, 2018, now U.S. Pat. No. 11,006,703, issued on May 18, 2021, which claims priority as a continuation-in-part of U.S. patent application Ser. No. 15/385,294, entitled "Metal One Piece Locking Slide and Pull for Slide Fastener", filed Dec. 20, 2016, now U.S. Pat. No. 10,064,457, issued on Sep. 4, 2018, which claims priority as a continuation-in-part of U.S. patent application Ser. No. 15/385,000, entitled "Metal One Piece Slide and Pull For Slide Fastener", filed Dec. 20, 2016, now U.S. Pat. No. 10,064,455, issued on Sep. 4, 2018, which claims the benefit of the priority of Indian Provisional Patent Application No. 201621011697, entitled "A Single Piece Slider and All Types of Manufacturing Process to Make a Single Piece Slider Thereof", filed Apr. 1, 2016; the contents of which are incorporated herein by reference.

FIELD OF INVENTION

The present invention generally relates to slide fasteners, commonly referred to as zippers, and more particularly, to a one piece security slider and pull made from metal for the slide fastener.

BACKGROUND INFORMATION

A zipper, zip, fly or zip fastener, formerly known as a clasp locker or slide fastener, is a commonly used device for binding the edges of an opening of fabric or other flexible material, like on a garment or a bag. It is used in clothing (e.g., jackets and jeans), luggage and other bags, sporting goods, camping gear, and other items.

The bulk of a zipper/zip consists of two rows of protruding teeth, which may be made to interdigitate, linking the rows, carrying from tens to hundreds of specially shaped metal or plastic teeth. These teeth can be either individual or shaped from a continuous coil, and are also referred to as elements. The slider is operated by hand, and moves along the rows of teeth. Inside the slider is a Y-shaped channel that meshes together or separates the opposing rows of teeth, depending on the direction of the slider's movement.

In general, a zipper represents a small amount of the overall cost of a product. However, if it fails, the entire garment or device may be unusable until the zipper is replaced or repaired. Problems often lie with the slider portion of the zipper. Sliders are typically made of a slide portion and a pull. The user grabs the pull, which is pivotally connected to the slide, and pushes or pulls the slide in one direction or the other to cause the slide to move. Movement of the slide causes the teeth to engage or disengage with each other as the movement occurs. Slides are typically manufactured to include one or more pieces to which the pull is later assembled. Assembly of the pull to the slide is usually accomplished by bending a bridge portion of the slide, which is die cast having a gap to create an interlocking engagement between the two components. Other methods require assembly of extra bridge components which may be bent, staked or otherwise secured to the slide. However, these constructions are weak and prone to breakage with repeated use, causing the pull to become separated from the slide. This problem is exacerbated when the zipper pull and slide are used to maintain the security of items like a suitcase. Secure storage, such as a suitcase or travel bag, have the additional issue of theft, as these items are regularly left with strangers and moved out of the control of the owner. Thus, the multi-piece slides and pulls are easily broken into pieces to allow entry into the container where items inside of the container can be stolen or manipulated.

It has been proposed in the past to form the slide and the pull in a single operation. However, the proposed methods, devices and resulting zipper products have been unable to be produced or are unacceptable to the industry when produced from metal. Producing a metal slider assembly with the pull interlocked with the bridge has proven to be extremely difficult due to the rigid properties of the metal, which makes tool retraction from around the formed part very difficult without modifying the geometry of the part in an undesirable manner.

For example, U.S. Pat. No. 2,736,062 to Scheuermann et al. discloses a method of molding a slide and pull together in a single operation. Scheuermann utilizes four slides that intersect at 45 degree angles with respect to each other. The slides intersect at the bridge and pull portions of the slider assembly with the pull positioned at a vertical right angle with respect to the top surface of the slide. However, this method, as shown in the drawings, requires the inner surfaces of the pull loop and the bridge to include 45 degree or similar angles that form sharp points along the inner surfaces. The sharp points cause stress risers in the part, and the sharp corners wear very quickly, causing any surface coatings to be worn away. This results in discoloration of the slide assembly, and often results in corrosion of the parts during a washing cycle. In addition, the modified geometry severely limits the movement of the pull within the bridge by reducing the space that the pull has to rotate and slide within the bridge.

U.S. Pat. No. 5,604,962 to Mayerhofer, U.S. Pat. No. 5,698,243 to Wakabayashi, U.S. Pat. No. 4,210,196 to Weiner, and U.K. Patent No 2,220,608 to Liso all show variations of the Scheuermann device, which all require the angles inside of the bridge and the pull to retract the tools. Even though the angles are not depicted in all of the patents, the tooling cannot be retracted through hardened metal, and thus must be there for the tooling to function.

U.S. Pat. No. 2,509,278 to Scheuermann discloses a mold that rotates the pull about its vertical axis to try and eliminate the angles on the inner surface of the pull loop. However, the angles are still required on the inner surface of the bridge, and the difficulty in producing the tools with the precision required for the pull rotation about the vertical axis has proven too costly.

U.S. Pat. No. 4,790,973 to Minami et al. discloses a different method and device for molding slider assemblies. Minami molds the slide first and, once the slide has solidified, a core is partially retracted to form the pull in a secondary molding operation while the slide is still positioned in the mold.

U.S. Pat. No. 5,013,511 to Akashi discloses yet another method and device for forming a zipper slide from metal. Akashi, like Minami, forms the slide portion in a first operation and forms the pull in a secondary operation. However, the pull of Akashi includes a pin which engages the bridge of the slide instead of the loop as disclosed in other prior art.

U.S. Pat. No. 4,985,969 to Terada et al. discloses yet another method and device for forming a zipper slide assembly. Terada forms the pull in combination with an intermediate pull portion with the two portions interlocked with a pin member that is formed within a mold as a secondary operation.

U.K. Patent Application No. 2,289,917 to YKK Corp. discloses a locking slider assembly. The YKK locking slider discloses forming the pull in a separate mold and placing the pull in a secondary mold where the slide is formed around a pin portion of the pull to complete the assembly.

Thus, a need in the art exists for a device and method of forming a slide in combination with a pull, wherein the slide and pull can be formed from metal without the need for modified geometry of the slide assembly, including internal angled surfaces in the bridge and the loop portion of the pull. A need also exists in the art for a slide and pull that operates to allow the slide to be locked with an external lock mechanism to maintain security of the items contained within the container.

The combined slide and pull assembly should satisfy the ergonomic needs that a zipper slide assembly must satisfy in order to achieve acceptance by the end user. This includes providing a slide bridge that includes an internal surface geometry that allows free movement and rotation of the pull. Further, the zipper slide assembly should not require excessive strength to operate or include oversized component parts. Moreover, the zipper slide assembly must assemble together in such a way so as not to detract from the aesthetic appearance of the completed zipper assembly or garment assembly. The slide assembly should include integrally formed lock loops that allow a slide to be locked in position with a padlock or similar locking device. Alternatively, there should be a pair of slides that each include integrally formed loops that allow the two slides to be secured together with a padlock to secure items stored in the container.

Thus, the present invention provides a die cast zipper slide assembly formed in a single operation which overcomes the disadvantages of prior art zipper slide assemblies formed in one or multiple operations. The zipper slide assembly of the present invention not only provides for relative ease in manufacturing, it also permits slides, pulls and locking loops to be manufactured together without the need to put motion limiting and failure prone angles on the inner surfaces of the bridge and pull loop. The present invention also provides a manufacturing method which utilizes at least one side shifting slide, thereby eliminating the need for slides that interlock at angles and require the part geometry to be modified to accommodate the slide angles.

SUMMARY OF THE INVENTION

Briefly, the invention involves a securable slider assembly for a zipper. The securable slider assembly is formed in a single die cast operation to include the securable slider and the pull being formed simultaneously. At least one side shifting slide is incorporated into the die, which allows the bridge and pull loop to be formed with their full geometric shape and without the converging flat surfaces required in the prior art. The slide assembly includes a puller that includes geometry to allow two slides to be secured together after the closing operation of the zipper teeth and restricts the ability to separate the pullers for opening of the zipper teeth to provide security to the user.

Accordingly, it is an objective of the present invention to provide a slider assembly for a zipper that includes a slider having a security loop, and a pull and is formed from metal in one operation.

It is a further objective of the present invention to provide a slider assembly including a slide with an integral security loop and a pull that is die cast to include its full geometry without the need for converging inner surfaces as required by the prior art.

It is yet a further objective of the present invention to provide a slider assembly for a zipper that includes a closed puller loop and a closed bridge on the slider.

It is another objective of the present invention to provide a method of manufacturing a security slider assembly for a zipper that includes at least one side shifting slide member for shifting the tool around a portion of the formed slide assembly.

It is yet another objective of the present invention to provide a method of manufacturing a slider assembly for a zipper that includes an integrally formed security loop constructed to cooperate with a padlock or other similar locking device to lock the slide in a fixed position.

It is still yet another objective of the present invention to provide a bridge and pull construction that provides security by integrally forming a closed security loop to the slide for securing the loop to another loop or a structure.

Still yet another objective of the present invention is to provide a pull member that includes a tunnel sized to cooperate with a security loop on an adjacent slide in a manner that encloses the loop; the tunnel and loop having aligned apertures to accept a locking device.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION OF THE PREFERRED EMBODIMENTS

Figure 1:
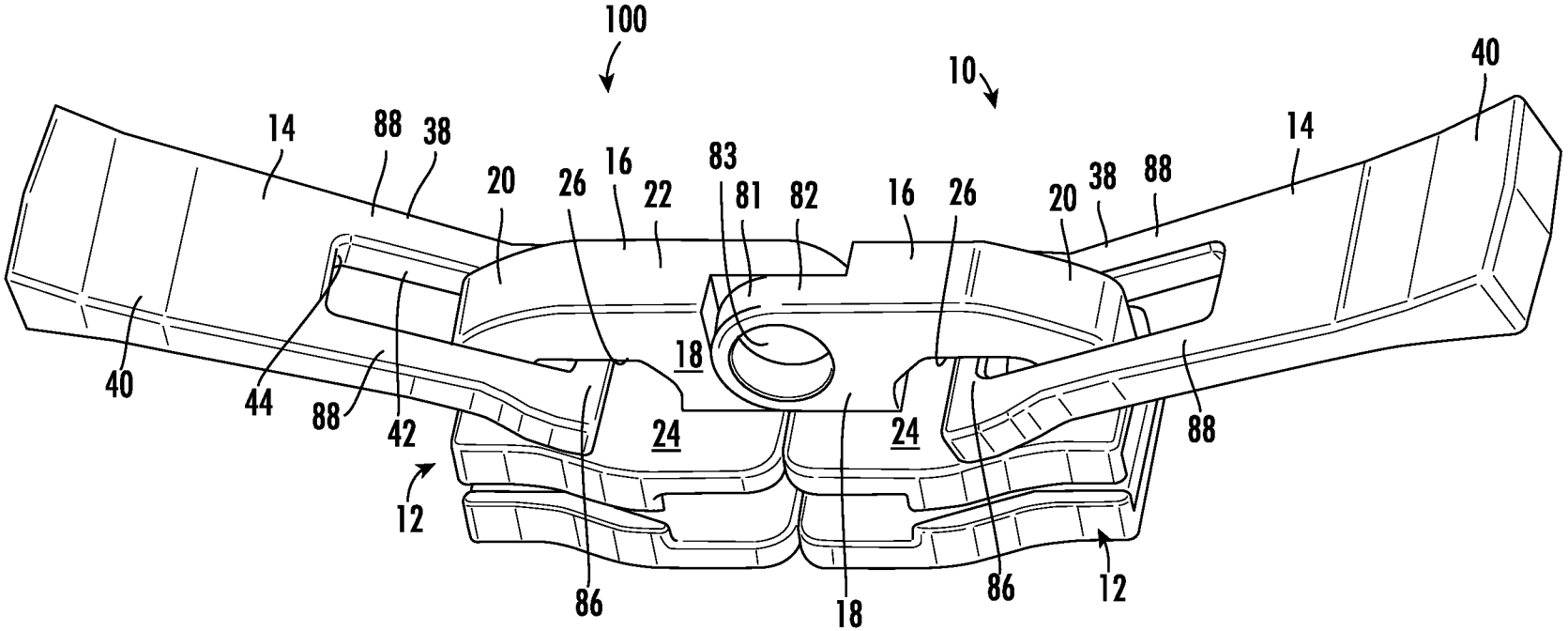
FIG. 1 is a top perspective view of one embodiment of the present invention illustrating a pair of sliders, each having an offset security loop integrally formed to the slider to align when adjacently positioned.
Figure 2:
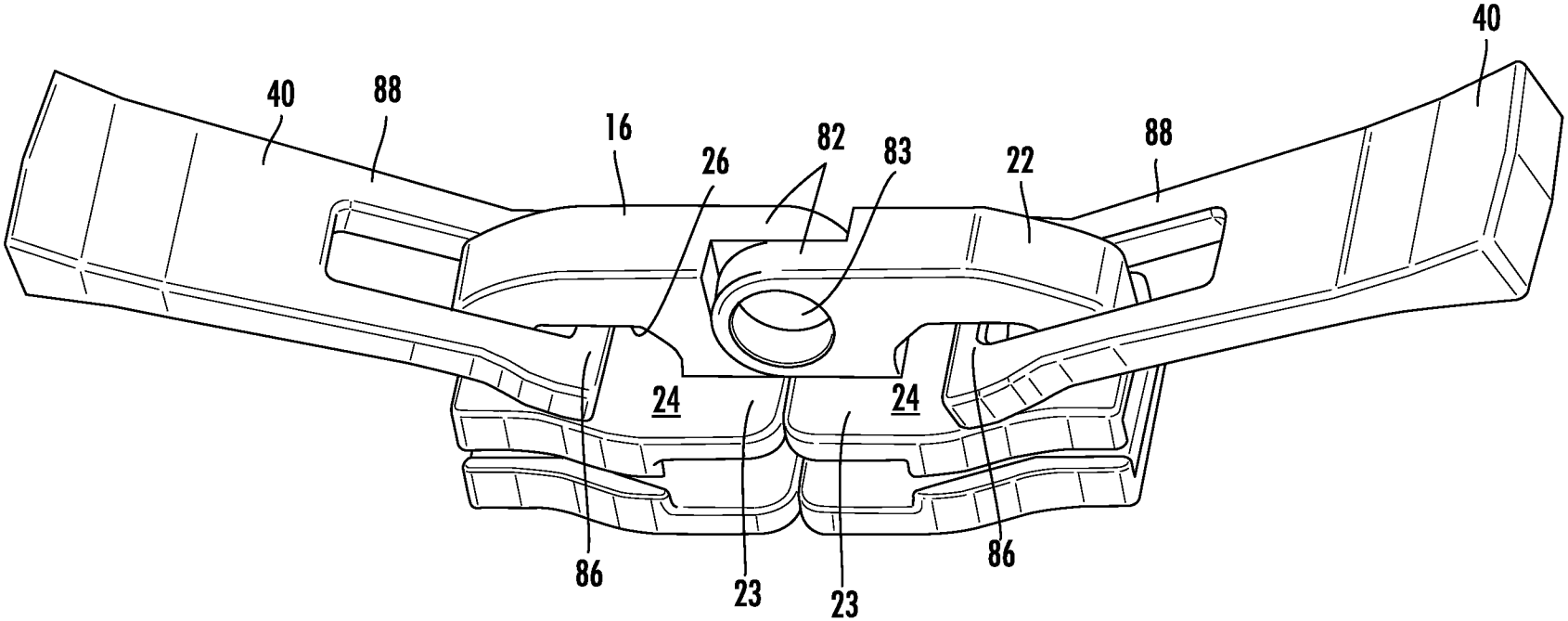
FIG. 2 is a partial top perspective view of the embodiment shown in FIG. 1, illustrating a pair of sliders each having an offset security loop integrally formed to the slider to align when adjacently positioned.
Figure 3:
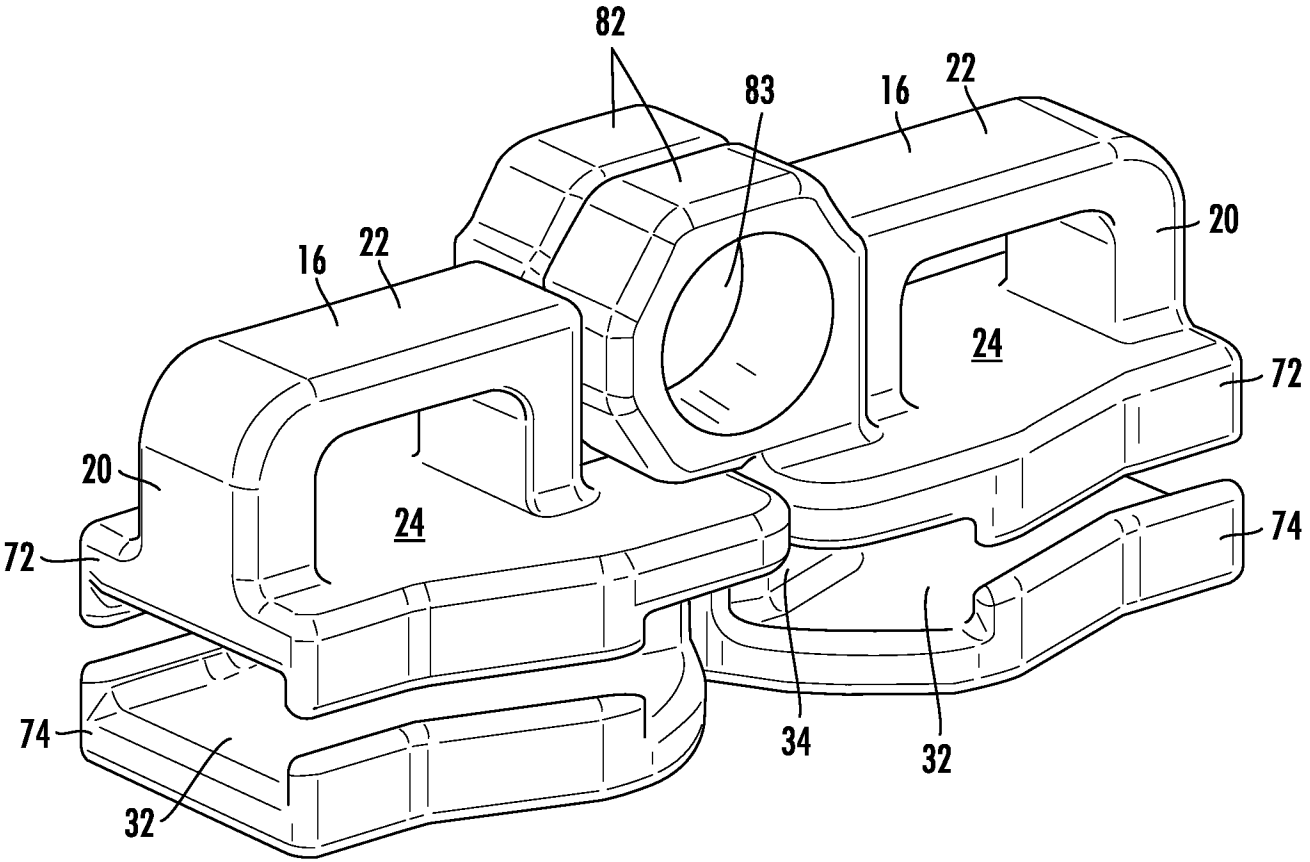
FIG. 3 is a front top left perspective view of a pair of security slide assemblies positioned to receive a locking device.
Figure 4:
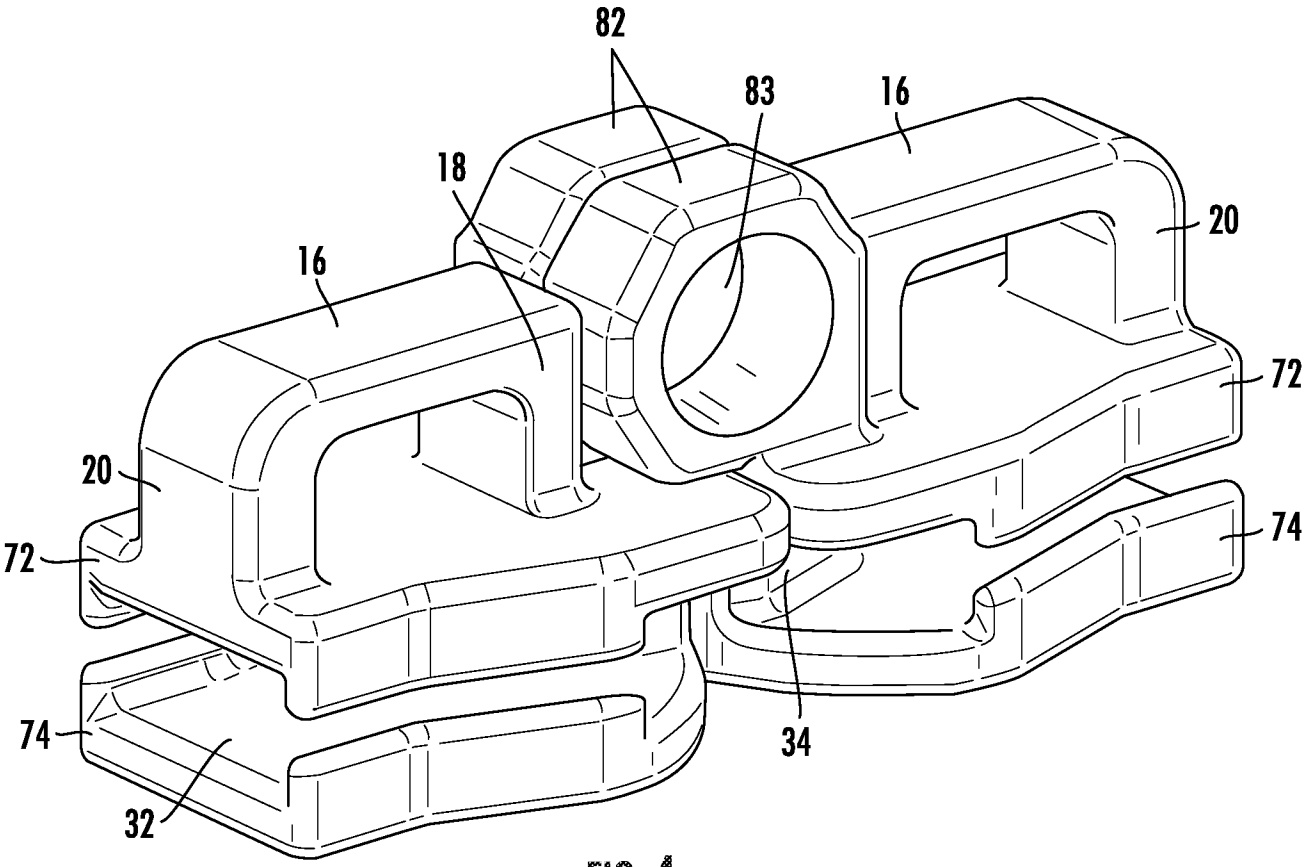
FIG. 4 is a perspective view of a pair of security slide assemblies positioned to receive a locking device.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring generally to FIGS. 1-11, a slide assembly (10) for zippers is illustrated. In its simplest form, the slide assembly (10) includes a slide member (12) and a pull member (14). The slide assembly (10) is preferably formed during a single operation in a die cast machine (not shown). The slide member (12) is formed to include a bridge (16) for locating and retaining the pull member (14) in a manner that allows for rotation and some linear translation of the pull member (14). The bridge (16) is also formed so that it does not include breaks or gaps which could weaken the bridge (16) and allow the pull member (14) to be released. Particularly, the bridge (16) includes a first end (18), a second end (20), and a central portion (22). Both the first and second ends (18) (20) are integrally formed to the top surface (24) of the slide (12). An inner surface (26) of the bridge is formed to be substantially flat as it extends transversely from side to side of the slide, but may include any desirable longitudinal contour for function or aesthetics. Because the bridge is integrally formed, corner radii (28) and fillets (30) may be formed during the die casting process to add strength and rigidity to the structure, as well as aesthetic appearance. The inner portion (32) of the slide (12) includes a splitter (34) which divides the inner portion (32) into a Y-shape for causing the zipper chain (not shown) to be joined or separated as is known in the art. In a preferred embodiment, the slide (12) includes an upper guide (72) and a lower guide (74) for guiding the zipper chain through the slide (12); the upper guide (72) and the lower guide (74) being separated and secured together with a splitter (34). The splitter and said guides (72) (74) are constructed and arranged to interlock the zipper chain when moved in a first direction, and disengage the zipper chain when moved in a second direction. At least one, and in some embodiments two, guide wall(s) (36) are integrally formed as part of the slider to help guide the teeth as they pass through the slider assembly (12).

Figure 5:
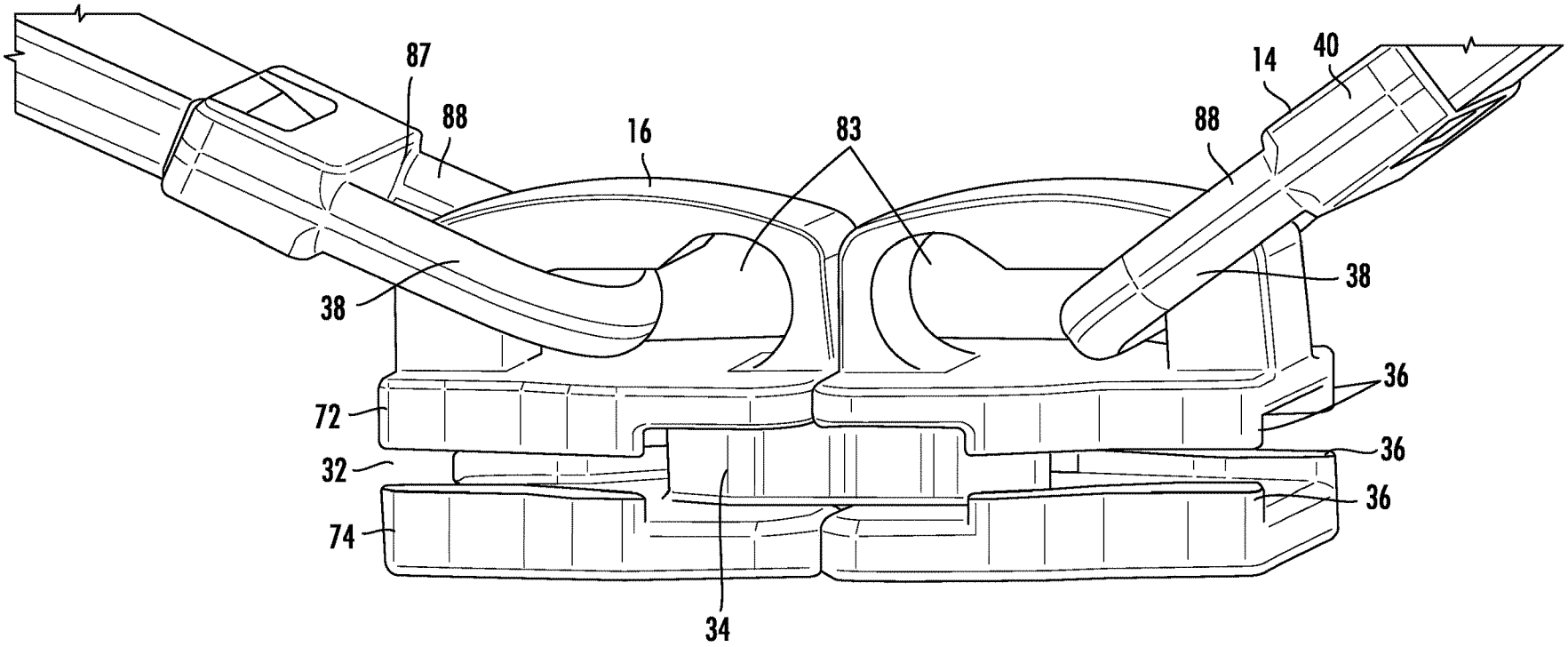
FIG. 5 is a perspective view illustrating a pair of sliders having enlarged loops formed as part of the bridge of the slide positioned to receive a locking device.

The pull (14) is formed in position around the bridge (16) to include a ring portion (38). The ring portion (38) is integrally formed to the first tab portion (40) to eliminate breakage and separation of the two components during use. The ring portion (38) may include any geometry desirable, which may include rounds, ovals, polygons and the like, so long as the geometry is complete and does not require converging flat surfaces that are required for removal of the tools from the formed part during manufacturing, as seen in the prior art. In the embodiment illustrated in FIG. 1, the ring portion (38) is formed to be square in cross section, having a substantially flat inner ring surface (42) with inner corners (44) providing the desired appearance and function to the overall slide assembly (10). FIG. 5 illustrates a slide assembly (10) having a ring portion (38) with a round cross section formed around the same or similar bridge construction as described in FIG. 1. In this embodiment, the ring geometry is formed complete and does not require relief geometry for the tooling retraction after forming.

Figure 6:
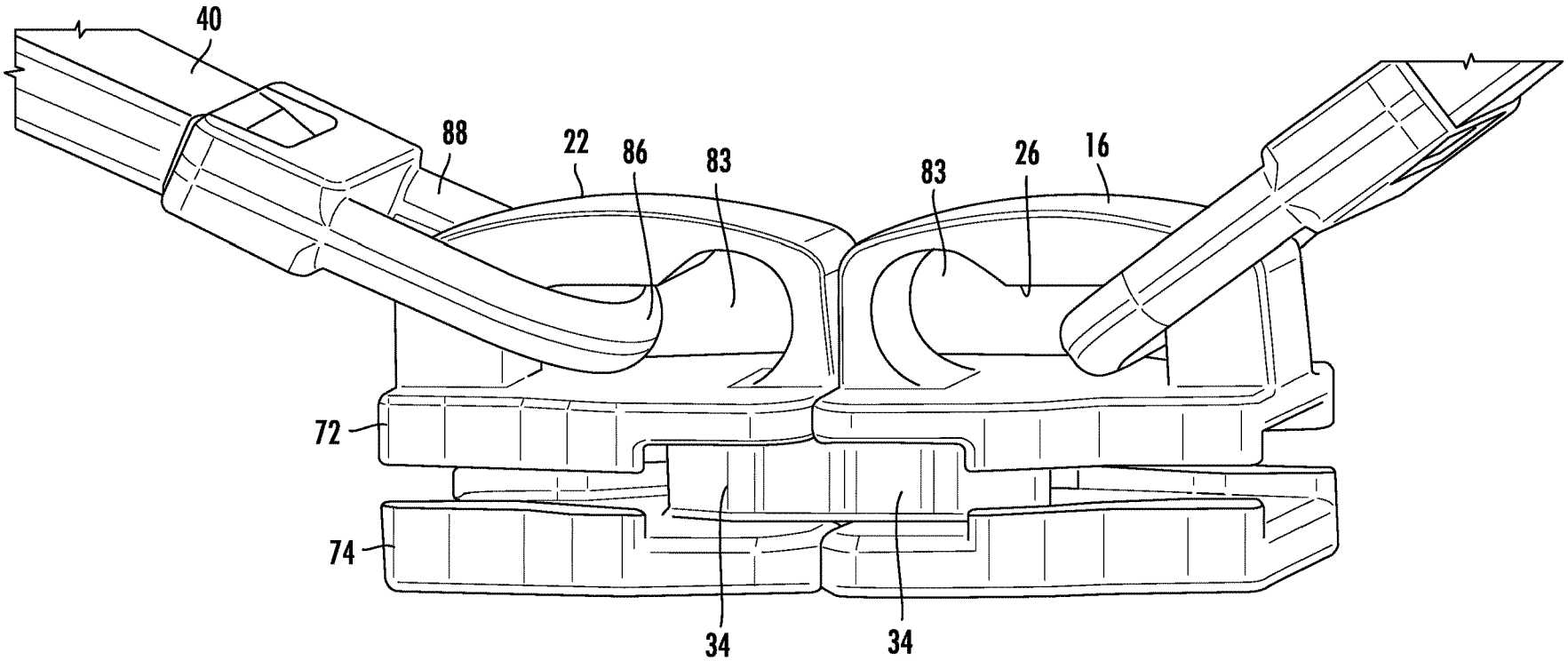
FIG. 6 is a perspective view illustrating a pair of sliders having enlarged loops formed as part of the bridge of the slide positioned to receive a locking device.
Figure 7:
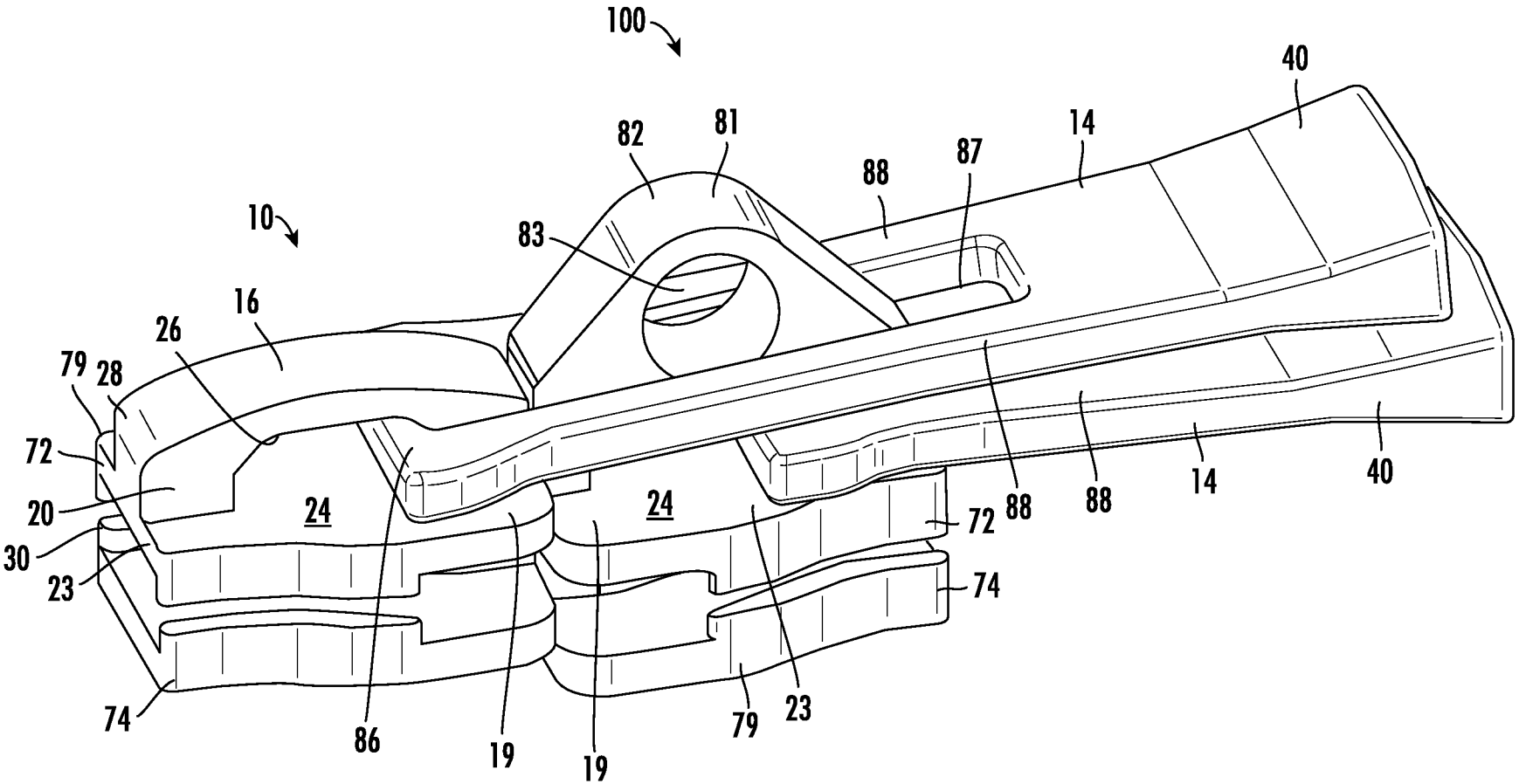
FIG. 7 is a perspective view illustrating an embodiment having a loop formed on a top surface of the bridge to cooperate with a pull of an adjacent slide and puller assembly.
Figure 8:
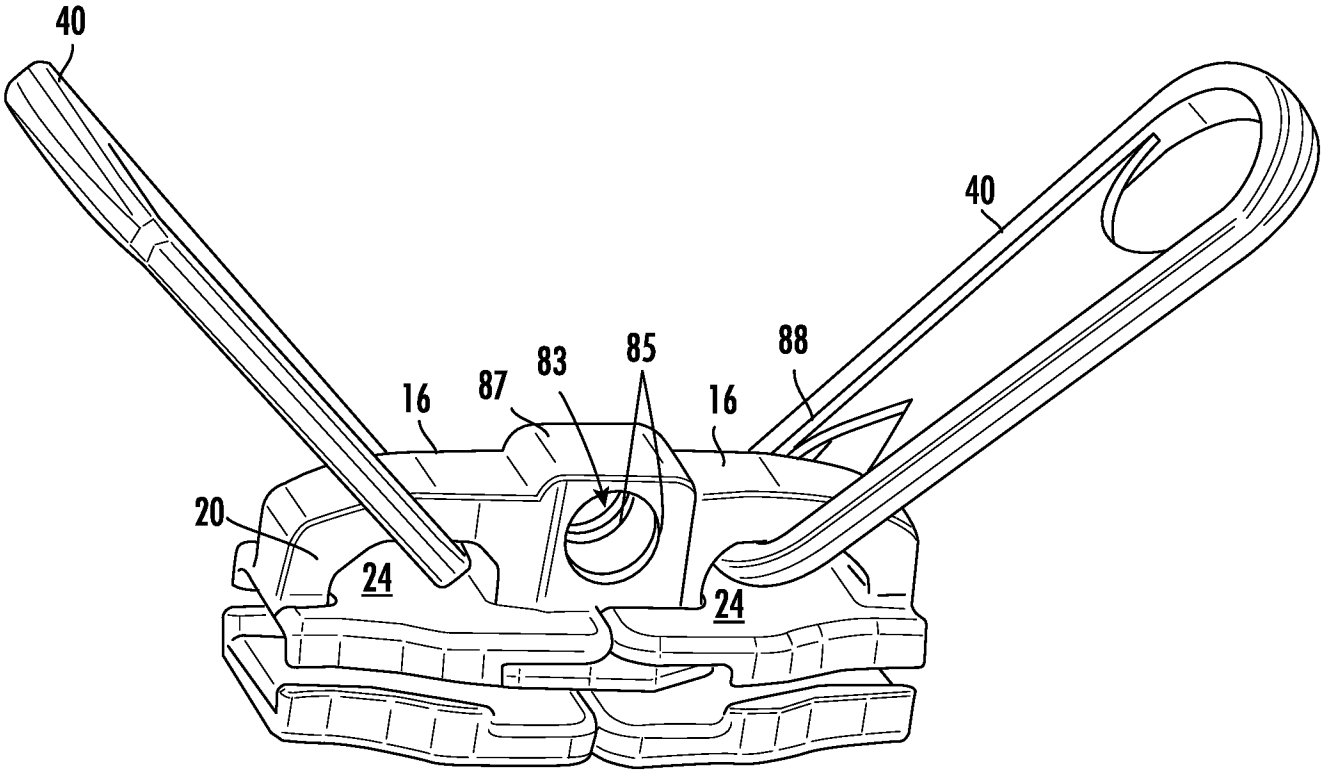
FIG. 8 is a perspective view illustrating an embodiment having a security loop formed as a tunnel and a second security loop positioned inside of the tunnel.
Figure 9:
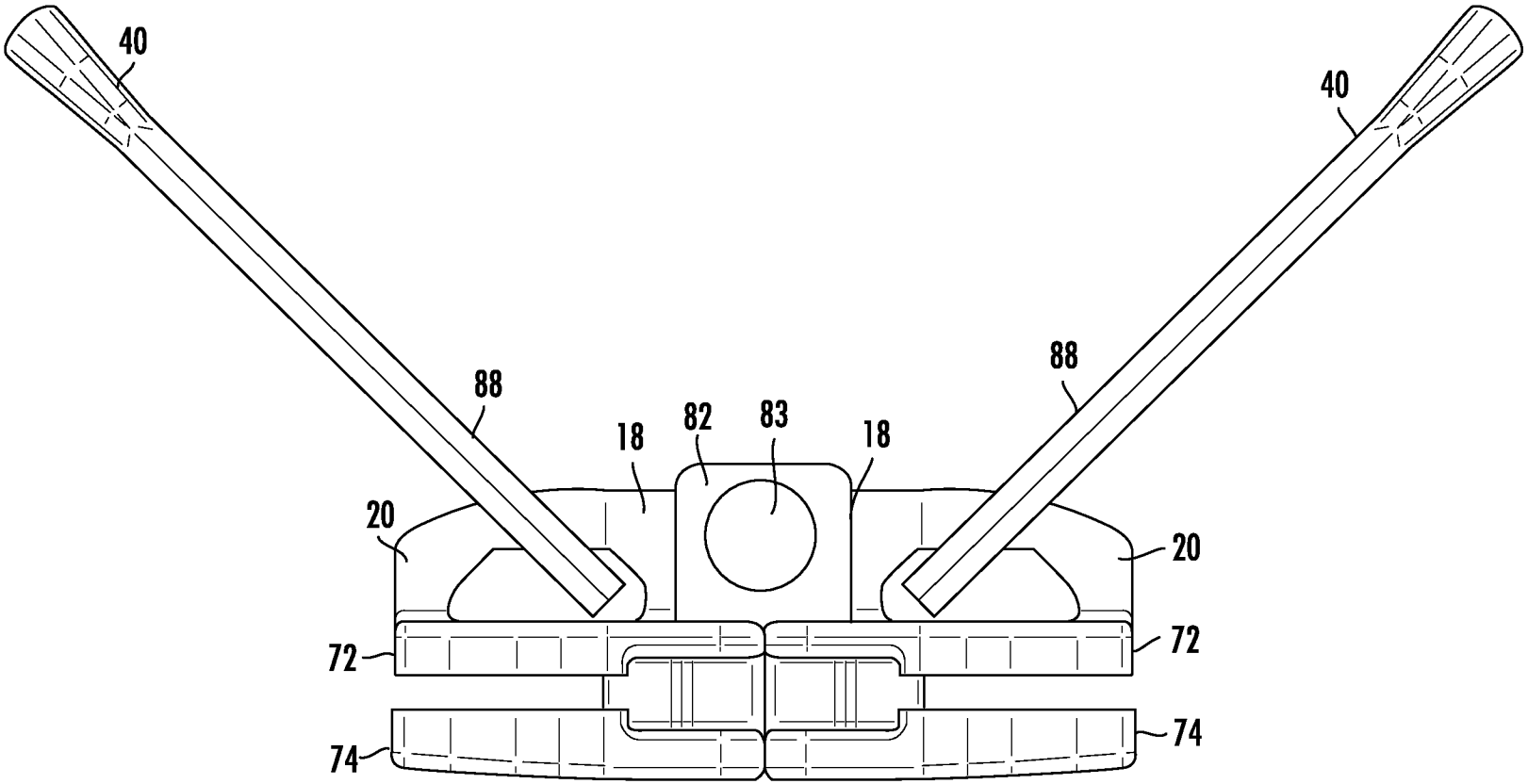
FIG. 9 is a side view of the embodiment illustrated in FIG. 8.
Figure 10:
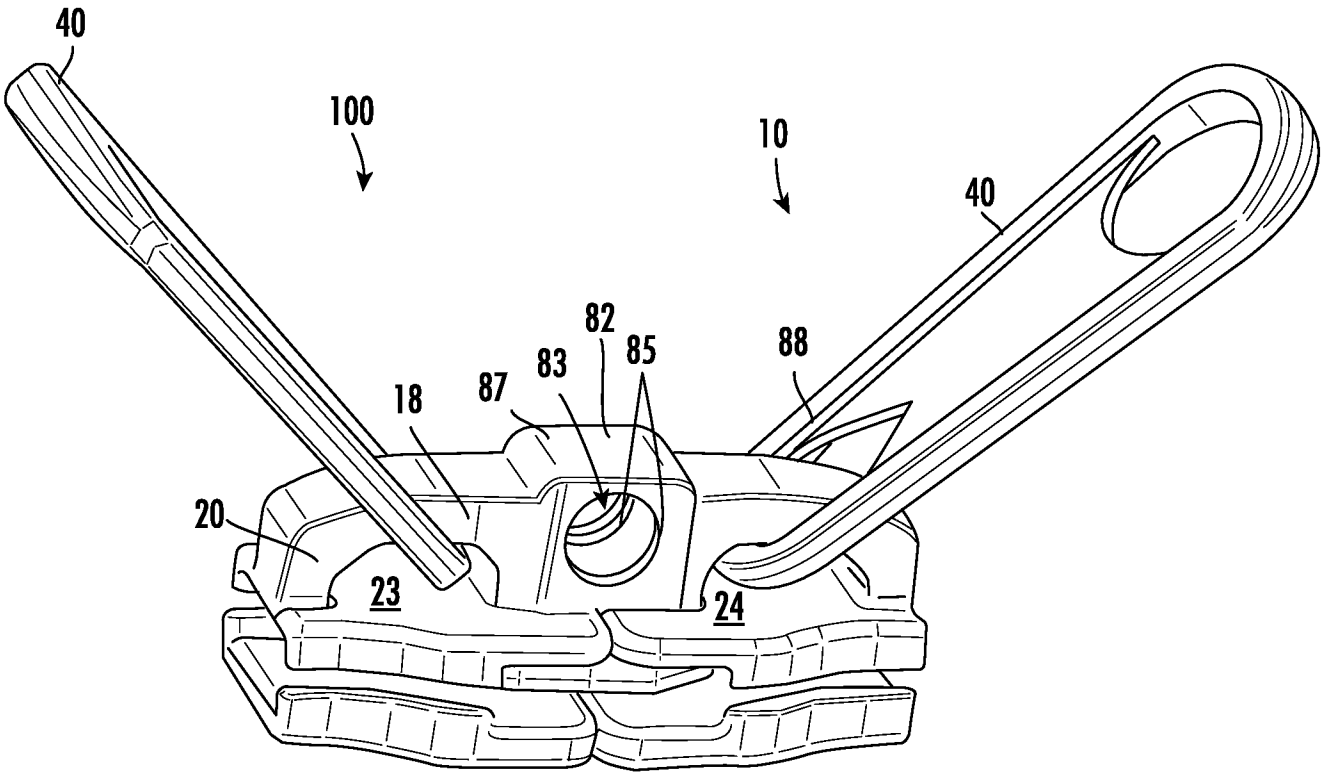
FIG. 10 is a perspective view of the embodiment illustrated in FIG. 8.

Still referring to FIGS. 1-11, the slide assembly (10) for a zipper, also known as a slide fastener, generally includes a slide member (12), the slide member (12) being constructed and arranged to open and close a zipper chain, the slide member (12) including a top plate (23) having a top surface (24), the top surface (24) including a bridge (16) having a first end (18) and a second end (20) both integrally formed to the top surface (24) such that there are no breaks, gaps or assemblies. An inner surface (26) of the bridge extends transversely across the bridge (16) in a substantially flat manner; the first end (18) of the bridge (16) having an integrally formed loop (82), including an aperture (83) arranged perpendicular with respect to a longitudinal centerline of the slide member (12). Alternatively, the loop (82) may be under the bridge (16) as shown in FIGS. 5 and 6, on top of the bridge as shown in FIG. 7, or formed as a pair of loop sections (85) that may be connected with an outer or upper wall. In a preferred embodiment, the loop (82) includes an outer surface (81) that is arranged to extend parallel to the aperture partially around the loop (82), the second end (20) of the bridge (16) extending to the rear portion of the top surface (24) where the bridge (16) and top surface (24) are integral with each other. The pull member (14) has a ring portion (38) and a tab portion (40), the ring portion (38) formed as a continuous ring around the bridge (16) and integrally formed to the tab portion (40), the ring portion (38) cooperating with the bridge (16) and loop (82) so that the pull member (14) can be rotated between the first end (18) of the bridge (16) and over the loop (82) to a first position that is substantially parallel to the top surface (24) and a second position wherein the pull member (14) is rotated over the second end (20) of the bridge (16) to be substantially parallel to the top surface (24). Substantially, as used herein, means within general manufacturing tolerances as used in the industry.

The pull member (14) ring portion (38) is generally constructed and arranged to include a pull-bar (86) and a pair of arms (88) extending between the tab portion (40) and the pull-bar (86), defining an opening (87) in the pull member, each of the arms (88) having a length greater than the distance from the inner surface (26) of the first end (18) of the bridge (16) to the most distal point of the outer surface (81) of the loop (82). In this manner, the pull member (14) is allowed to travel the length of the bridge (16) to provide directional forces to the slide (12) for opening and closing the zipper chain.

In a most preferred embodiment, a second slide assembly (100) is provided on the same zipper chain, positioned in opposing directions, which allows one or both of the zipper pulls to be utilized to open and close the zipper chain. In the present system, the second slide assembly (100) is positioned on the same zipper chain as the slide assembly (10), so that a first end (19) of each of the respective top plates (23) abut when the slide assembly (10) and the second slide assembly (100) are positioned adjacent with respect to each other. This construction allows the two zipper slide assemblies (10) (100) to be secured or locked together with a locking device, which may be as simple as a zip tie (not shown) to something as sophisticated as a padlock or combination lock (not shown). Locking the slides together prevents the zipper chain from being opened, even if the slide assemblies are moved around the chain. Alternatively, the slide assemblies (10) (100) may be independently or simultaneously secured to a portion of the garment or container to which they are used to prevent the slide assemblies (10) (100) from being moved to open the zipper chain. Thus, when the slide assemblies (10) (100) are positioned adjacently, the loop portion (82) preferably extends beyond the distal end of the top surface (24) and is offset to one side of the longitudinal centerline of the slide member (12), so that when the slide assembly (10) and the second slide assembly (100) are positioned adjacent with respect to each other, the loop portions (82) overlap with the apertures (83), aligning with respect to each other. In at least one embodiment, the loop portion (82) of the slide assembly (10) extends beyond the distal end of the top surface (24) along the longitudinal centerline of the slide member (12), and the loop portion (82) of the second slide assembly (100) extends beyond the distal end of the top surface (24) along the longitudinal centerline of the slide member (12). In this embodiment, the loop portion (82) of the second slide assembly (100) is formed as two parallel loop sections (85), the parallel loop sections (85) arranged to overlap opposite sides of the loop portion (82) of the slide assembly (10) with the apertures (83) of the loop portion (82) and the loop sections (85) aligning with respect to each other. In at least one embodiment, the second slide assembly (100) includes a top wall (87) connecting the top surfaces of the loop sections (85).

Referring generally to the figures, and most particularly to FIG. 7, an embodiment of the present device is illustrated wherein the loop portion (82) of the slide assembly (10) extends above a top surface of the bridge (16) along the longitudinal centerline of the slide member (12). The second slide assembly (100) is positioned on the same zipper chain as the slide assembly (10) so that a first end (19) of each of the respective top plates (23) abut when the slide assembly (10) and the second slide assembly (100) are positioned adjacent with respect to each other, each of the arms (88) extending between the tab portion (40) and the pull-bar (86), having a length greater than the distance from the inner surface (26) of the first end (18) of the bridge (16) of the slide assembly (10) to the most distal point of the outer surface (81) of the loop (82) of the second slide assembly (100). In this manner, the pull member (14) of the first slider assembly (10) can be rotated over the loop (82) of the second slide assembly (100) to secure the two slide assemblies (10) (100) together with a locking device.

Figure 11:
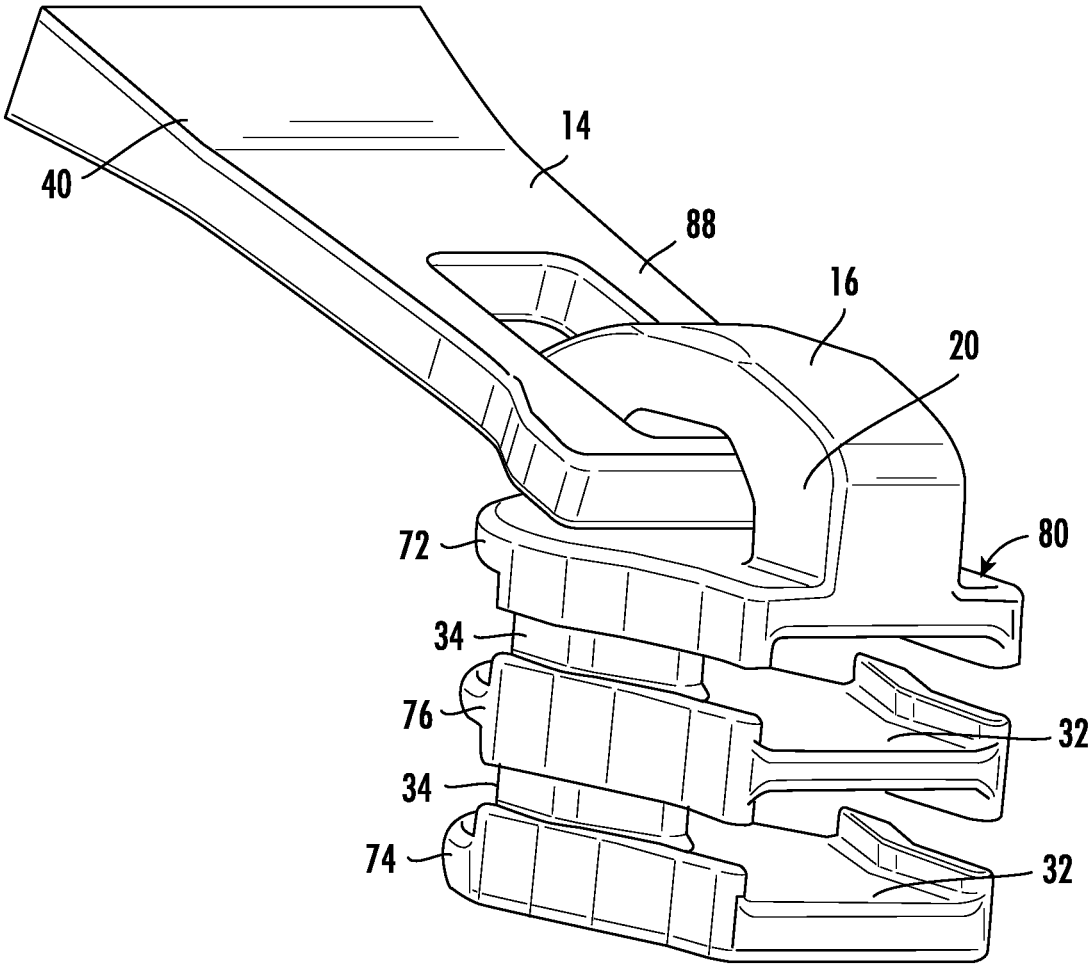
FIG. 11 is a partial perspective view illustrating an embodiment of the present device that is constructed to cooperate with two separate rows of interlocking teeth.

Still referring to FIGS. 1-11, it should be noted that while the figures illustrate both single chain sliders and double chain sliders, the single and double slider portion of the assemblies applies to all of the embodiments interchangeably without departing from the scope of the invention. When constructed as single sliders, the slide member (12) includes an upper guide (72) and a lower guide (74) separated and secured together with a first splitter (34), wherein the splitter (34) and the guides (72) and (74) are constructed and arranged to interlock a zipper chain when moved in a first direction, and disengage the zipper chain when moved in a second direction. FIG. 11 illustrates one embodiment of a double chain slider assembly (80) applicable to any of the sliders contained herein. In this embodiment, the slide member (12) includes an upper guide (72), a middle guide (76) and a lower guide (74) for guiding a first zipper chain (not shown) and a second zipper chain (not shown) through the slide member (12). The upper guide (72) and the middle guide (76) are separated and secured together with a first splitter (34), while the middle guide (76) and the lower guide (74) are separated and secured together with a second splitter (35). The splitters (34) (35) and the guides (72) (76) (74) are constructed and arranged to interlock a first zipper chain and a second zipper chain (not shown) when moved in a first direction, and disengage the first zipper chain and the second zipper chain when moved in a second direction. This embodiment may be used for zipper chains that are the same or different from the first to the second zipper chain. This embodiment applies to waterproof zipper chains and the like, wherein one zipper chain provides fastening, while the second zipper chain provides water proofing.

Referring to FIGS. 1-11, it should be noted that the pulls or slide assemblies (10) (100) may include indicia (not shown), in the form of logos, figures, characters or the like, that are integrally formed as part of the slider assembly (10) (100). This also includes, but should not be limited to, serial numbers, lot numbers, part numbers, patent numbers, trademarks and the like. It should also be noted that the present embodiments are specifically utilized for forming slider assemblies from metal in a die casting process, and thus various metals may be utilized, including, but not limited to, zinc, aluminum, magnesium, titanium, copper, brass and suitable combinations thereof.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement of parts herein described and shown. It will be apparent to those skilled in the art that various changes may be made without departing from the scope of the invention, and the invention is not to be considered limited to what is shown and described in the specification.

One skilled in the art will readily appreciate that the present invention is well adapted to carry out the objects and obtain the ends and advantages mentioned, as well as those inherent therein. Any compounds, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A slide assembly (10) for a zipper comprising:

a slide member (12), the slide member being constructed and arranged to open and close a zipper chain, the slide member (12) including a top plate (23) having a top surface (24), the top surface (24) including a bridge (16) having a first end (18) and a second end (20) both integrally formed to the top surface (24), an inner surface (26) of the bridge (16) extending transversely across the bridge (16), the first end (18) having an integrally formed loop (82), the loop (82) including an aperture (83) arranged perpendicular with respect to a longitudinal centerline of the slide member (12), the loop (82) having an outer surface (81) that is arranged to extend parallel to the aperture (83) partially around the loop (82), the second end (20) of the bridge (16) extending to the rear portion of the top surface (24) where the bridge (16) and top surface (24) are integral with each other;

a pull member (14) having a ring portion (38) and a tab portion (40), the ring portion (38) formed as a continuous ring around the bridge (16) and integrally formed to the tab portion (40), the ring portion cooperating with the bridge and loop (82) so that the pull member (14) can be rotated between the first end (18) of the bridge (16) and over the loop (82) to a first position that is substantially parallel to the top surface (24) and a second position wherein the pull member (14) is rotated over the second end (20) of the bridge (16) to be substantially parallel to the top surface (24).

2. The slide assembly (10) for a zipper of claim 1 wherein the pull member (14) ring portion (38) includes a pull-bar (86) and a pair of arms (88) extending between the tab portion (40) and the pull-bar (86) defining an opening (87) in the pull member, each of the arms (88) having a length greater than the distance from the inner surface (26) of the first end (18) of the bridge (16) to the most distal point of the outer surface (81) of the loop (82).

3. The slide assembly (10) for a zipper of claim 1 including a second slide assembly (100) having a second slide member, the second slide member including a top plate (23) having a top surface (24), the top surface (24) including a bridge (16) having a first end (18) and a second end (20) both integrally formed to the top surface (24), an inner surface (26) of the bridge (16) extending transversely across the bridge (16), the first end (18) having an integrally formed loop (82), the loop (82) including an aperture (83) arranged perpendicular with respect to a longitudinal centerline of the slide member (12), the loop (82) having an outer surface (81) that is arranged to extend parallel to the aperture (83) partially around the loop (82), the second end (20) of the bridge (16) extending to the rear portion of the top surface (24) where the bridge (16) and top surface (24) are integral with each other; the second slide assembly (100) positioned on the same zipper chain as the slide assembly (10) so that a first end (19) of each of the respective top plates (23) abut when the slide assembly (10) and the second slide assembly (100) are positioned adjacent with respect to each other.

4. The slide assembly (10) for a zipper of claim 3 wherein the loop portion (82) extends beyond the distal end of the top surface (24) and is offset to one side of the longitudinal centerline of the slide member (12) so that when the slide assembly (10) and the second slide assembly (100) are positioned adjacent with respect to each other, the loop portions (82) overlap with the apertures (83), aligning with respect to each other.

5. The slide assembly (10) for a zipper of claim 3 wherein the loop portion (82) of the slide assembly (10) extends beyond the distal end of the top surface (24) along the longitudinal centerline of the slide member (12), the loop portion (82) of the second slide assembly (100) extending beyond the distal end of the top surface (24) along the longitudinal centerline of the slide member (12), the loop portion (82) of the second slide assembly (100) formed as two parallel loop sections (85), the parallel loop sections (85) arranged to overlap the opposite sides of the loop portion (82) of the slide assembly (10) with the apertures (83) of the loop portion (82) and the loop sections (85) aligning with respect to each other.

6. The slide assembly (10) for a zipper of claim 5 wherein the second slide assembly (100) includes a top wall (87) connecting the top surfaces of the loop sections (85).

7. The slide assembly (10) for a zipper of claim 2 wherein the loop portion (82) of the slide assembly (10) extends above a top surface of the bridge (16) along the longitudinal centerline of the slide member (12), a second slide assembly (100), having a second slide member, the second slide member including a top plate (23) having a top surface (24), the top surface (24) including a bridge (16) having a first end (18) and a second end (20) both integrally formed to the top surface (24), an inner surface (26) of the bridge (16) extending transversely across the bridge (16), the first end (18) having an integrally formed loop (82), the loop (82) including an aperture (83) arranged perpendicular with respect to a longitudinal centerline of the slide member (12), the loop (82) having an outer surface (81) that is arranged to extend parallel to the aperture (83) partially around the loop (82), the second end (20) of the bridge (16) extending to the rear portion of the top surface (24) where the bridge (16) and top surface (24) are integral with each other, the second slide assembly (100) positioned on the same zipper chain as the slide assembly (10) so that a first end (19) of each of the respective top plates (23) abut when the slide assembly (10) and the second slide assembly (100) are positioned adjacent with respect to each other, each of the arms (88) extending between the tab portion (40) and the pull-bar (86), having a length greater than the distance from the inner surface (26) of the first end (18) of the bridge (16) of the slide assembly (10) to the most distal point of the outer surface (81) of the loop (82) of the second slide assembly (100).

8. The slide assembly (10) for a zipper of claim 1 wherein the slide member (12) of the slide assembly (10) is a single chain slider member (79) including an upper guide (72) and a lower guide (74) separated with a first splitter (34), wherein the splitter (34) and the guides (72) and (74) are constructed and arranged to interlock a zipper chain when moved in a first direction, and disengage the zipper chain when moved in a second direction.

9. The slide assembly (10) for a zipper of claim 3 wherein the slide member (12) of the second slide assembly (100) includes a single chain slider member (79) including an upper guide (72) and a lower guide (74) separated with a first splitter (34), wherein the splitter (34) and the guides (72) and (74) are constructed and arranged to interlock a zipper chain when moved in a first direction, and disengage the zipper chain when moved in a second direction.

10. The slide assembly (10) for a zipper of claim 1 wherein the slide member (12) of the slide assembly (10) includes a double chain slider member (80), the double chain slider member (80) having an upper guide (72), a middle guide (76) and a lower guide (74) for guiding a first zipper chain and a second zipper chain through the slide member (12); the upper guide (72) and the middle guide (76) are separated and secured together with a first splitter (34), while the middle guide (76) and the lower guide (74) are separated and secured together with a second splitter (35), the splitters (34) (35) and the guides (72) (76) (74) are constructed and arranged to interlock the first zipper chain and the second zipper chain when moved in a first direction, and disengage the first zipper chain and the second zipper chain when moved in a second direction.

11. The slide assembly (10) for a zipper of claim 3 wherein the slide member (12) of the second slide assembly (100) includes a double chain slider member (80), the double chain slider member (80) having an upper guide (72), a middle guide (76) and a lower guide (74) for guiding a first zipper chain and a second zipper chain through the slide member (12); the upper guide (72) and the middle guide (76) are separated and secured together with a first splitter (34), while the middle guide (76) and the lower guide (74) are separated and secured together with a second splitter (35), the splitters (34) (35) and the guides (72) (76) (74) are constructed and arranged to interlock the first zipper chain and the second zipper chain when moved in a first direction, and disengage the first zipper chain and the second zipper chain when moved in a second direction.

* * * * *